US006955113B2

(12) United States Patent
Demers

(10) Patent No.: US 6,955,113 B2
(45) Date of Patent: Oct. 18, 2005

(54) ELECTRO-HYDRAULIC ACTUATOR WITH MECHANICAL SERVO POSITION FEEDBACK

(75) Inventor: Dennis G. Demers, Mishawaka, IN (US)

(73) Assignee: Honeywell International Inc., Morristown, NJ (US)

( * ) Notice: Subject to any disclaimer, the term of this patent is extended or adjusted under 35 U.S.C. 154(b) by 75 days.

(21) Appl. No.: 10/289,886

(22) Filed: Nov. 7, 2002

(65) Prior Publication Data

US 2004/0089144 A1 May 13, 2004

(51) Int. Cl.[7] ..... F15B 9/10
(52) U.S. Cl. ..... 91/382
(58) Field of Search ..... 91/382, 358 R

(56) References Cited

U.S. PATENT DOCUMENTS

| | | | | | |
|---|---|---|---|---|---|
| 383,901 | A | | 6/1888 | Neu | |
| 686,942 | A | | 11/1901 | Hegarat | |
| 1,518,894 | A | | 12/1924 | Bliss | |
| 2,969,808 | A | | 1/1961 | Horlacher | |
| 3,039,988 | A | * | 6/1962 | Trinkler | 91/382 |
| 3,942,327 | A | | 3/1976 | Noe | |
| 3,967,533 | A | * | 7/1976 | Tyler | 91/382 |
| 4,011,891 | A | * | 3/1977 | Knutson et al. | 91/382 |
| 4,033,233 | A | * | 7/1977 | Toi | 91/382 |
| 4,177,713 | A | | 12/1979 | Lewis et al. | |
| 4,335,645 | A | | 6/1982 | Leonard | |
| 4,365,770 | A | | 12/1982 | Mard et al. | |
| 4,450,753 | A | | 5/1984 | Basrai et al. | |
| 4,807,517 | A | | 2/1989 | Daeschner | |
| 5,014,667 | A | | 5/1991 | Meyer | |
| 5,179,888 | A | | 1/1993 | Schendel et al. | |
| 5,346,360 | A | | 9/1994 | Cooper | |
| 5,735,122 | A | | 4/1998 | Gibbons | |
| 5,735,503 | A | | 4/1998 | Hietkamp | |
| 5,899,064 | A | | 5/1999 | Cheung | |
| 5,938,124 | A | | 8/1999 | Lowi, Jr. | |
| 5,997,431 | A | | 12/1999 | Vukovich et al. | |

FOREIGN PATENT DOCUMENTS

| | | |
|---|---|---|
| EP | 1 054 161 A1 | 11/2000 |
| GB | 1 445 680 A | 8/1976 |

* cited by examiner

*Primary Examiner*—Edward K. Look
*Assistant Examiner*—Michael Leslie
(74) *Attorney, Agent, or Firm*—Larry J. Palguta

(57) ABSTRACT

A method and apparatus for an electro-hydraulic actuator (1) having mechanical feedback provide closed loop control with a high degree of accuracy. The electro-hydraulic actuator (1) includes a current versus load generator (10), a single-stage servomechanism (20, 21, 22, 23), and a device (24, 25, 40, 41) for providing a mechanical feedback force for offsetting an input force (Fsol) of the current versus load generator (10).

11 Claims, 2 Drawing Sheets

ELECTRO-HYDRAULIC ACTUATOR WITH MECHANICAL SERVO POSITION FEEDBACK

TECHNICAL FIELD AND INDUSTRIAL APPLICABILITY OF THE INVENTION

The present invention is generally directed to the field of electro-hydraulic actuators, and more particularly to a method and an apparatus utilizing a highly accurate electro-hydraulic actuator having a force generator to establish closed loop control.

BACKGROUND OF THE INVENTION

The inventor of the present invention has determined that there are numerous shortcomings with the methods and apparatus of the background art relating specifically to electro-hydraulic actuators.

Electro-hydraulic actuators that are required to maintain a high level of accuracy are typically controlled with servovalves and use position feedback to achieve closed loop control, e.g., with electrical devices. The position feedback may be accomplished by electrical devices such as LVDTs (Linear Variable Differential Transformer), RVDTs (Rotary Variable Differential Transformer), potentiometers, resolvers, Hall effect sensors, or piezo-resistive sensors.

However, there are applications where accurate electro-hydraulic actuators are required and electrical feedback is not available. In these situations, mechanical feedback must be used to maintain closed loop control. In a single-stage type, electro-hydraulic servovalve, a mechanical leaf spring or other spring force from the actuator is normally used to provide the mechanical feedback. As the size or the slew velocity of the actuator increases, the volumetric flow demand eventually exceeds the capacity of the servovalve, e.g., a jet-pipe, and a higher capacity flapper orifice design or a two-stage servovalve is typically required.

The present inventor has determined that it is extremely difficult to attempt to set a higher capacity two-stage servovalve with mechanical feedback from both the second stage as well as the actuator piston (first stage). In addition, the inventor of the present invention has determined that the accuracy of electro-hydraulic servovalves with mechanical feedback is typically limited to only eight percent or higher.

There are several examples of electro-hydraulic servovalves relating to the foregoing discussion of the background art. For example, U.S. Pat. No. 4,335,645 to Leonard, the entirety of which is hereby incorporated by reference, describes a direct drive, two-stage electro hydraulic servo valve incorporating hydro-mechanical position feedback.

However, the inventor of the present invention has determined that this type of complex electro-hydraulic servovalve is relatively expensive and difficult to utilize in practice. As aforementioned, attempting to set a higher capacity two-stage servovalve with mechanical feedback such as that described in the Leonard patent from both the first and second stage is extremely difficult. In the fluidic repeater described by Leonard, the second stage of the servo valve is hydraulically controlled by mechanical feedback from the position piston.

U.S. Pat. No. 4,4450,753 to Basrai et al., the entirety of which is herein incorporated by reference, describes an electro-hydraulic proportional actuator. However, this system requires electrical position feedback. Specifically, a pair of three way solenoid valves is used to position an actuator assembly having a double-acting, linear piston. An electronic control circuit using electrical position feedback nulls out the system and operates the solenoid valves to control fluid flow through the respective ports of the solenoid valves.

U.S. Pat. No. 4,807,517 to Daeschner, the entirety of which is hereby incorporated by reference, describes an electro-hydraulic proportional actuator including at least a piston, a valve for driving the piston into operating positions, a solenoid for producing a driving force for controlling the valve, and a plurality of springs for biasing the piston, solenoid and valve components. In this actuator, compression spring(s) are directly applied to the solenoid plunger and a sliding link rod to produce a force that counters the magnetic pull of the solenoid coil. When an electrical control signal is zero, the compression spring will force the solenoid plunger and the spool rod to the right (as seen and shown in FIG. 1 of Daeschner).

However, as aforementioned, it has been determined that the electro-hydraulic servovalves with mechanical feedback of the background art suffer from the above-described limitations, including being limited in their accuracy to eight percent or higher error rates.

SUMMARY OF THE PRESENT INVENTION

The present invention overcomes the shortcomings associated with the background art and achieves other advantages not realized by the background art. The present invention is intended to alleviate one or more of the following problems and shortcomings of the background art specifically identified by the inventor with respect to the background art.

The present invention, in part, is a recognition that it will be advantageous to implement a simplified and relatively easily controlled electro-hydraulic actuator utilizing mechanical servo position feedback.

The present invention, in part, is a recognition that an electro-hydraulic actuator using mechanical servo position feedback with a high level of accuracy has heretofore not been achieved by the background art.

The present invention, in part, provides an electro-hydraulic actuator comprising a single stage servomechanism; a current versus load generator, the current versus load generator capable of energizing the single stage servomechanism with an input force, the input force controlling the single stage servomechanism to regulate a regulated servo pressure controlled by the electro-hydraulic actuator.

The electro-hydraulic actuator may further comprise a mechanical feedback device producing a mechanical feedback force for offsetting the input force of the load generator, wherein the mechanical feedback force provides closed loop control of the electro-hydraulic actuator.

The present invention, also in part, provides methods of providing closed loop control for an electro-hydraulic actuator, said method comprising the steps of energizing a single stage servomechanism with a current versus load generator to produce an input force; and offsetting the input force of said load generator with a mechanical feedback force to achieve closed loop control of the actuator, e.g., through a roller assembly.

BRIEF DESCRIPTION OF THE DRAWINGS

The present invention will become more fully understood from the detailed description given hereinafter and the accompanying drawings that are given by way of illustration only, and thus do not limit the present invention.

DETAILED DESCRIPTION OF THE PREFERRED EMBODIMENTS

Figure 1:
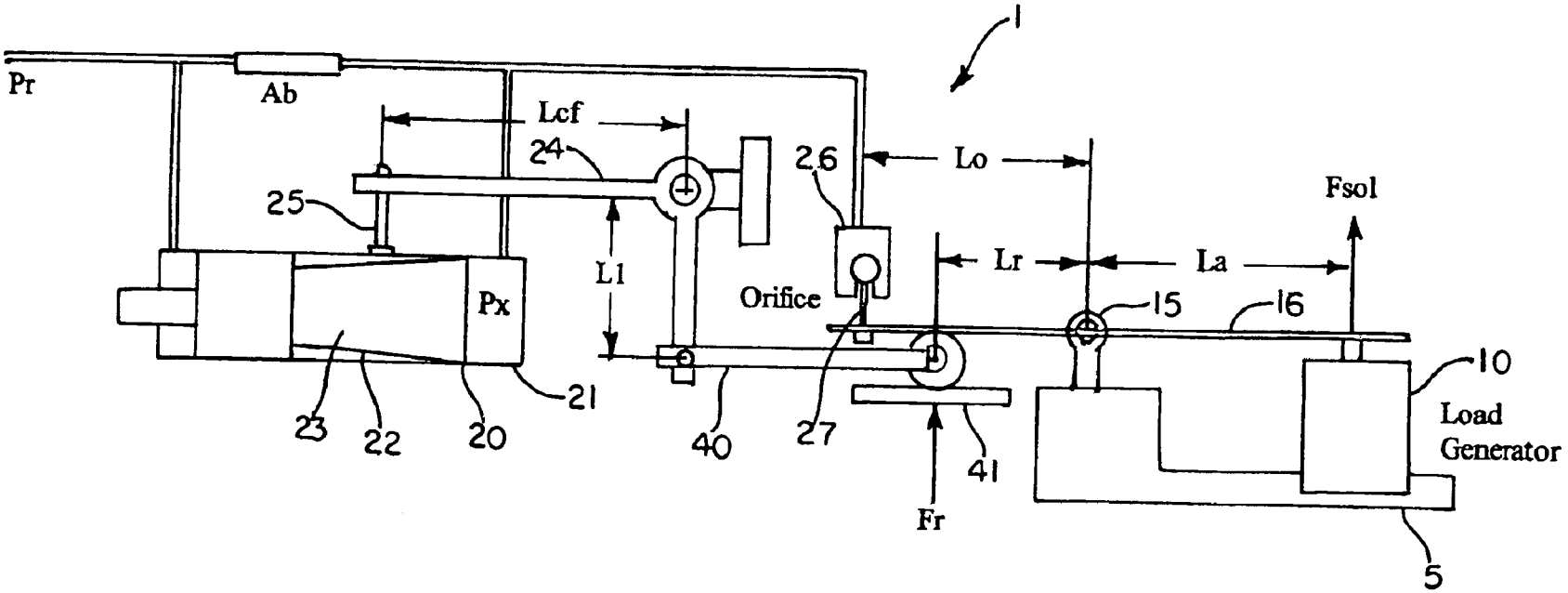
FIG. 1 is a schematic view of an electro-hydraulic actuator utilizing mechanical servo position feedback according to an embodiment of the present invention.
Figure 2:
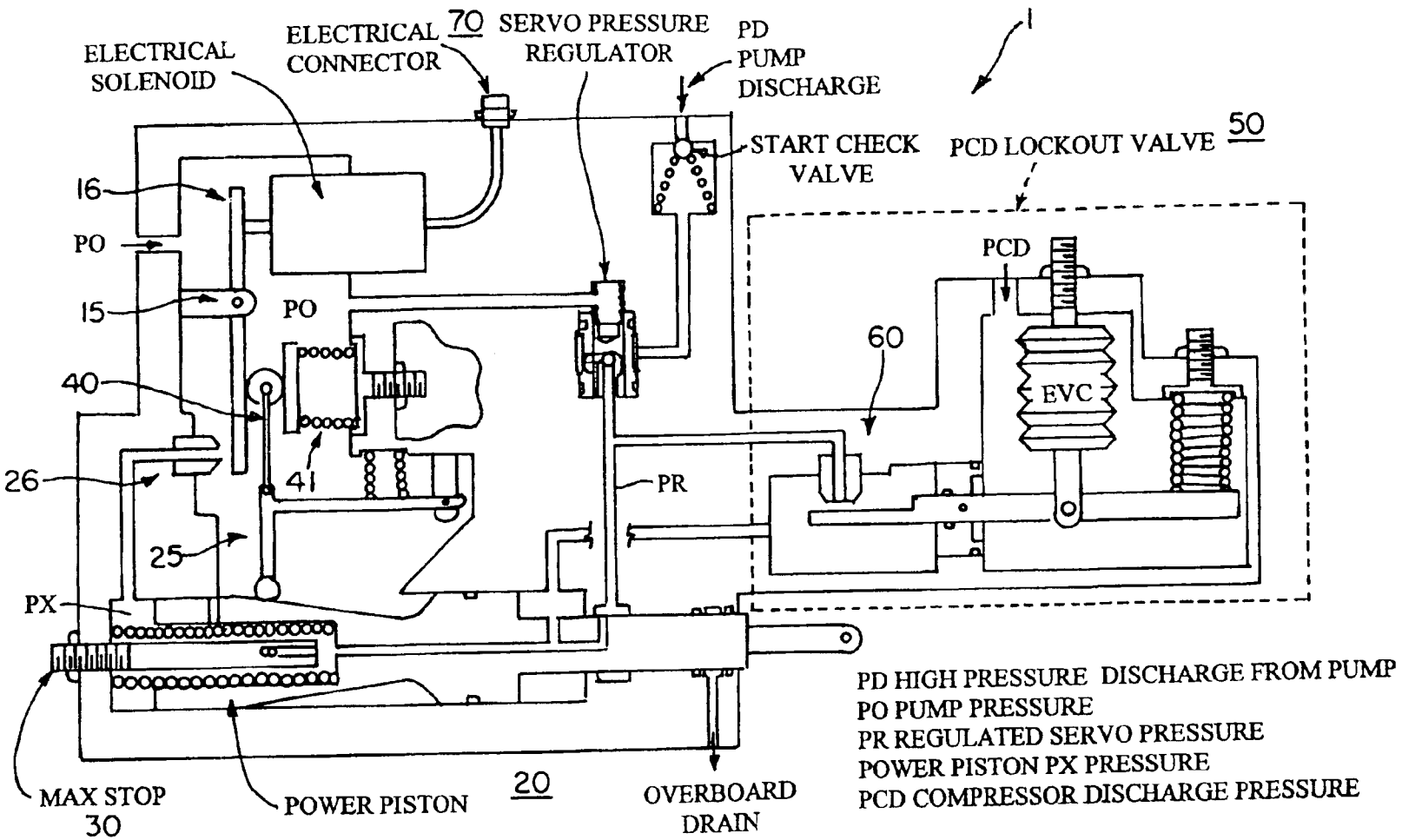
FIG. 2 is a schematic view of an electro-hydraulic actuator utilizing mechanical servo position feedback shown in operation with a high pressure compressor and pump according to an exemplary embodiment of the present invention.

The present invention will now be described in detail with reference to the accompanying drawings. FIG. 1 is a schematic view of an electro-hydraulic actuator utilizing mechanical servo position feedback according to an embodiment of the present invention. FIG. 2 is a schematic view of an electro-hydraulic actuator utilizing mechanical servo position feedback shown in operation with a high pressure compressor and pump according to an exemplary embodiment of the present invention.

For many years the Bendix Corporation designed and used computational hydromechanical feedback servomechanism(s) to provide accurate control of subsystems in large gas generator fuel controls. These mechanisms typically sense one or more pneumatic pressures, perform hydromechanical computations, and move an actuator piston to perform some desired function such as positioning a cam or valve in response. The present invention utilizes a similar concept to these types of servomechanisms of the background art. However, the input force that is normally provided by the pneumatic pressure(s) acting upon a bellows is created by a load generator in the present invention, e.g., similar to the magnetic coil of a solenoid or torque motor.

In FIG. 1, an electro-hydraulic actuator 1 with a load generator 5 is shown. The load generator 5 includes a solenoid 10 that generates a solenoid force Fsol that serves as an input force to the electro-hydraulic actuator 1. The solenoid force Fsol acts via the pivot 15 and the lever arm 16 to control the power piston 20 pressure Px via a control orifice 26 and a flapper valve assembly 27. The power piston 20 is capable of reciprocating in a linear motion within a control cylinder 21. The power piston 20 pressure Px is varied in proportion to the Fsol via the control orifice 26.

An increase in power piston 20 pressure Px results in the power piston 20 moving away, e.g., to the left as seen in FIG. 1 and to the right in FIG. 2. A decrease in power piston 20 pressure Px results in a movement of the power piston 20 in the opposite direction, e.g., to the right as seen in FIG. 1. As seen in FIG. 2, one of skill in the art will appreciate that the power piston 20 is biased with a spring-biased, adjustable stop 30 in a preferred embodiment. The resulting or regulated servo pressure Pr occurs on the opposite side of the power piston 20 assembly and is further controlled with a servo pressure regulator 70. In the example shown in FIG. 2, a compressor discharge lockout valve 50 is operatively controlled by the regulated servo pressure via a second orifice 60.

The power piston 20 includes a cam 22 having a cam surface 23 with a predetermined slope S. The cam 22 and cam surface 22 is engaged with a cam follower 25 and lever assembly 24 that provides mechanical feedback to the load generator 5 via a roller assembly 40 operatively connected via the cam follower 25 and lever assembly 24. The cam follower 25 is arranged to follow the cam surface 22 throughout the power piston's 20 travel.

When the power piston 20 has moved to the desired linear position, e.g., the power piston 20 pressure Px and servo pressure Pr are at their desired values, the lever assembly transfers a mechanical feedback force via the roller assembly 40 that offsets or nullifies the initial load generator force Fsol. When the solenoid force Fsol, e.g., the input force, is nullified, the mechanical feedback via the roller assembly 40 is completed and thereby provides closed loop mechanical feedback to the electro-hydraulic actuator 1. A trim spring 41 is provided that spring biases the mechanical feedback force of the roller assembly 40 in a preferred embodiment.

FIG. 2 is a schematic view of an electro-hydraulic actuator utilizing mechanical servo position feedback shown in operation with a high pressure compressor and pump according to an exemplary embodiment of the present invention. This actuator 1 was designed to meet specific requirements for an APU (Auxiliary Power Unit) engine application. In addition, one of skill in the art will appreciate that Po designates the pump pressure, Pr designates the servo pressure regulator pressure, Px designates the power piston 20 pressure, and Pcd is the compressor discharge pressure. In the load generator shown connected with a pivoted lever assembly, e.g., with a solenoid, Fsol is the solenoid force.

One of skill in the art will appreciate that a single shaft engine (gas turbine) normally drives a load via a reduction gearbox. This reduction gearbox may then be used to also drive engine accessories, e.g., such as fuel and oil pumps. A typical load is normally an electrical generator, mechanical pump or in some cases a second air compressor. However, a single shaft engine cannot normally accept any kind of load until it has started and accelerated to operating speed. Therefore, it is normally the case that all mechanical load should be removed from an operating gas turbine before it is shut down. For example, many aircraft APUs are single shaft designs with the aforementioned characteristics.

Alternatively, twin shaft gas turbines have the advantage that they can be started with a mechanical load applied. The compressor part of the engine or "Gas generator" is started and accelerated up to speed. The exhaust from the gas generator spins a power turbine driving the load. This type of small gas turbine is especially useful for starting larger engines and is known as a gas turbine starter (GTS) or jet fuel starter.

The power turbine in a twin shaft gas turbine must either drive a load or be connected to a mechanical governor so that the gas generator speed can be controlled to prevent the power turbine from over-speeding. GTS units do not always employ a governor, instead a speed sensing device shuts the GTS down when the load reaches a pre-determined speed. In addition, some GTS units are fitted with power turbine governing systems and can also drive loads such as AC generators and operate as APUs.

In the embodiment shown in FIG. 2, a Start Check Valve (SCV) ensures that the actuator 1 will be fully extended during an engine start. After a start has been made and the APU accelerates to 100% speed, the SCV opens and the piston jumps out to a position determined by a machined cut in the piston that throttles servo supply pressure from which Px is derived. At approximately 60% engine speed, a sufficient level of Pcd has been typically been attained to open the Pcd Lockout Valve. The piston is then permitted to continue to travel to a position determined by the solenoid load cell. The restrictor in the piston and or the overboard drain, e.g., as shown in the exemplary embodiment, are necessary to produce the desired Px pressure to position the piston.

TABLE I and TABLE II include experimental values for a current versus load generator utilizing mechanical feedback as described hereinabove. As seen in TABLE I, the slope S of the cam surface can be represented in degrees, e.g., 14 degrees, and/or in terms of length versus current, e.g., inches of cam follower 25 travel along the cam surface per mA of solenoid current. This linear relationship between length and current permits accurate mechanical feedback in response to an input force from an electrical input device, e.g., a load generator with a solenoid. The mechanical feedback force provided by the spring-biased roller assembly 40 is accordingly proportional to the servoposition feedback, e.g., the servoposition or cam position obtained and related by the cam follower 25 and lever assembly. In TABLE II, the relationships between mA of solenoid current, Fsol and piston travel are shown.

One of skill in the art will also appreciate that mechanical feedback may be achieved by alternative sources not shown by the spring-biased, roller assembly of the preferred embodiments shown in the accompanying figures. For example, the present inventor has determined that it may be possible to also provide mechanical feedback by using a combination(s) of a hydraulically loaded piston or bellows assembly that receives a pressure signal that is biased as a function of the piston being positioned by the load solenoid. It may also possible to use a series of pivoted levers and springs manipulated by the piston to derive a position feedback signal.

TABLE I

| | |
|---|---|
| Pivot to Solenoid | Ls = 1.0 |
| Pivot to Trim Spring | Lts = 1.0 |
| Pivot to Orifice | Lo = 1.5 |
| Reference Spring Load | Fr = 10.0 |
| Flapper Orifice Area | Ao = 0.00196 calculated |
| Flapper Orifice Diameter | Do = 0.05 |
| Servo Pressure | Pr − Po = 150 |
| Solenoid Force | Fsol = Column H calculated |
| Pivot to Roller | Lr = Column I calculated |
| Slope (inch per mA) | S = 0.0083 0.0082 |
| Cam Follower Lever Ratio (Lcf/L) | Rcf = 1.36 |
| Cam Follower Lever to Cam | Lcf = 0.952 calculated |
| Cam Follower to Roller | L1 = 0.7 |
| Cam Slope in Degrees | Angle = 14 |
| mA to Fs Multiplier | Rma = 0.015 |

TABLE II

| mA | Fsol | Lr | Index Lr @ mA = 0 | Piston Travel | Index Travel | Piston Travel Required |
|---|---|---|---|---|---|---|
| 0 | 0 | −0.044 | 0 | 0 | 0.000 | 0.00 |
| 20 | 0.3 | −0.014 | 0.03 | 0.164 | 0.000 | 0.00 |
| 40 | 0.6 | 0.016 | 0.06 | 0.327 | 0.142 | 0.14 |
| 60 | 0.9 | 0.046 | 0.09 | 0.491 | 0.305 | 0.30 |
| 80 | 1.2 | 0.076 | 0.12 | 0.655 | 0.469 | 0.47 |
| 100 | 1.5 | 0.106 | 0.15 | 0.818 | 0.633 | 0.63 |
| 120 | 1.8 | 0.136 | 0.18 | 0.982 | 0.796 | 0.80 |
| 140 | 2.1 | 0.166 | 0.21 | 1.145 | 0.96 | 0.96 |

What is claimed is:

1. An electro-hydraulic actuator comprising:

a single stage servomechanism;

a current versus load generator, said current versus load generator being capable of energizing said single stage servomechanism with an input force, said input force controlling said single stage servomechanism to regulate a regulated servo pressure controlled by said electro-hydraulic actuator, wherein said load generator includes a solenoid creating said input force;

a control orifice;

a flapper valve pivotably connected to said load generator and operatively engaged with said control orifice for regulating a hydraulic fluid, wherein said flapper valve is spring-biased; and a mechanical feedback device producing a mechanical feedback force for offsetting said input force of the load generator, wherein said mechanical feedback force provides closed loop control of said electro-hydraulic actuator, wherein said mechanical feedback device includes a roller assembly producing said mechanical feedback force, and a lever assembly, said lever assembly being operatively connected to said roller assembly to transfer said mechanical feedback force to said load generator and operatively connected to said cam follower engaged with the sloped cam surface.

2. A method of providing closed loop control for the electro-hydraulic actuator according to claim 1, said method comprising the steps of:

energizing the single stage servomechanism with the current versus load generator to produce the input force; and offsetting the input force of said load generator with the mechanical feedback force to achieve closed loop control of said actuator.

3. An electro-hydraulic actuator comprising:

a single stage servomechanism, wherein said single stage servomechanism includes a power piston including a sloped cam surface; and a cam follower, said cam follower operatively engaged with said sloped cam surface of said power piston;

a current versus load generator, said current versus load generator being capable of energizing said single stage servomechanism with an input force, said input force controlling said single stage servomechanism to regulate a regulated servo pressure controlled by said electro-hydraulic actuator; and a mechanical feedback device producing a mechanical feedback force for offsetting said input force of the load generator, wherein said mechanical feedback force provides closed loop control of said electro-hydraulic actuator through said cam follower, wherein said mechanical feedback device includes a roller assembly producing said mechanical feedback force, and a lever assembly, said lever assembly being operatively connected to said roller assembly to transfer said mechanical feedback force to said load generator and operatively connected to said cam follower engaged with the sloped cam surface.

4. The electro-hydraulic actuator according to claim 3, said mechanical feedback force is produced by at least one of a hydraulically loaded piston biased by a received pressure signal, a hydraulically loaded bellows assembly biased by a received pressure signal, a plurality of pivoted levers, and a plurality of springs manipulated by a piston or bellows assembly, to derive a position feedback signal.

5. The electro-hydraulic actuator according to claim 4, wherein said mechanical feedback force is produced by a combination of a hydraulically loaded piston biased by a received pressure signal and at least one of a hydraulically loaded bellows assembly, a plurality of pivoted levers, and a plurality of springs manipulated by a piston or bellows assembly to derive a position feedback signal.

6. The electro-hydraulic actuator according to claim 3, wherein said load generator includes a solenoid creating said input force.

7. An electro-hydraulic actuator comprising:

a single stage servomechanism, wherein said single stage servomechanism includes a power piston including a sloped cam surface;

a cam follower, said cam follower operatively engaged with said sloped cam surface of said power piston;

a current versus load generator, said current versus load generator being capable of energizing said single stage servomechanism with an input force, said input force controlling said single stage servomechanism to regulated a regulated servo pressure controlled by said electro-hydraulic actuator;

a mechanical feedback device producing a mechanical feedback force for offsetting said input force of the load generator, wherein said mechanical feedback force provides closed loop control of said electro-hydraulic actuator through said cam follower, wherein said mechanical feedback device includes a roller assembly producing said mechanical feedback force, and a lever assembly, said lever assembly being operatively connected to said roller assembly to transfer said mechanical feedback force to said load generator;

a control orifice; and a flapper valve pivotably connected to said load generator and operatively engaged with said control orifice.

8. The electro-hydraulic actuator according to claim 7, wherein said load generator includes a solenoid creating said input force.

9. The electro-hydraulic actuator according to claim 8, wherein said flapper valve is spring biased.

10. A method of providing closed loop control for the electro-hydraulic actuator according to claim 9, said method comprising the steps of:

energizing the single stage servomechanism with the current versus load generator to produce the input force; and offsetting the input force of said load generator with the mechanical feedback force through said roller assembly to achieve closed loop control of said actuator.

11. The electro-hydraulic actuator according to claim 7, wherein said flapper valve is spring biased.

* * * * *